US010765289B2

(12) United States Patent
Goff

(10) Patent No.: US 10,765,289 B2
(45) Date of Patent: Sep. 8, 2020

(54) DUAL FLUID SYSTEM FOR FLOOR MAINTENANCE MACHINE

(71) Applicant: RPS Corporation, Racine, WI (US)

(72) Inventor: Sean K. Goff, Breckenridge, CO (US)

(73) Assignee: RPS Corporation, Racine, WI (US)

( * ) Notice: Subject to any disclaimer, the term of this patent is extended or adjusted under 35 U.S.C. 154(b) by 430 days.

(21) Appl. No.: 15/886,466

(22) Filed: Feb. 1, 2018

(65) Prior Publication Data

US 2018/0228332 A1 Aug. 16, 2018

Related U.S. Application Data

(60) Provisional application No. 62/459,334, filed on Feb. 15, 2017.

(51) Int. Cl.

| | |
|---|---|
| ***A47L 11/40*** | (2006.01) |
| ***A47L 11/03*** | (2006.01) |
| ***A47L 11/283*** | (2006.01) |
| ***A47L 13/12*** | (2006.01) |
| ***A47L 11/32*** | (2006.01) |

(52) U.S. Cl.

CPC ..... *A47L 11/408* (2013.01); *A47L 11/03* (2013.01); *A47L 11/283* (2013.01); *A47L 11/4013* (2013.01); *A47L 13/12* (2013.01); *A47L 11/325* (2013.01)

(58) Field of Classification Search

CPC ..... A47L 11/408

See application file for complete search history.

*Primary Examiner* — Andrew A Horton

(74) *Attorney, Agent, or Firm* — Quarles & Brady LLP

(57) ABSTRACT

A floor maintenance machine includes a clean water tank and a brush deck. A first and second fluid supply system place the clean water tank in fluid communication with outlet(s) at the brush deck. The first fluid supply system includes a first fluid supply line adapted to receive a soap or detergent therein supplied from a soap or detergent well. The second fluid supply system includes an ozone generator and a second fluid supply line adapted to receive injected ozone therein with the ozone being generated from the ozone generator.

13 Claims, 4 Drawing Sheets

DUAL FLUID SYSTEM FOR FLOOR MAINTENANCE MACHINE

CROSS-REFERENCE TO RELATED APPLICATION

This application claims the benefit of U.S. Provisional Patent Application No. 62/459,334 filed on Feb. 15, 2017, the contents of which are incorporated by reference for all purposes as if set forth in their entirety herein.

STATEMENT OF FEDERALLY SPONSORED RESEARCH OR DEVELOPMENT

Not applicable.

BACKGROUND

This invention relates to equipment for floor maintenance machines and, in particular, to fluid supply systems for supplying cleaning fluid to a brush deck.

Floor maintenance machines or scrubbers provide a way to clean dirty floor surfaces. Typically, an operator directs a floor maintenance machine over the surface to be cleaned by steering or guiding the floor maintenance machine. With the help of a supplied cleaning fluid, an oscillating pad or rotating brushes of the floor maintenance machine can directly contact the floor surface to loosen debris that is on the surface of the floor.

The cleaning fluid is supplied to the brush deck from a clean water tank using a fluid supply system. Typically, this system involves one or more fluid lines that connect the clean water tank to the fluid outlet at the brush deck. Depending on the particular fluid supply system, there may be intermediate components which help to provide the cleaning agent to the fluid stream.

In many conventional fluid supply systems, the water is mixed with a soap or detergent. In such systems, the operator may measure the amount of soap or detergent directly place it in the clean water tank to mix it with the water. Alternatively, some systems may have a separate soap or detergent well and the soap or detergent may be introduced into the fluid as the fluid is transported through the fluid line.

More recently, some floor cleaning machines have replaced traditional soap-based systems with ozone-generation systems. In many cases, the water itself is processed to create ozone-containing or highly oxygenated water. Such systems are of increasing interest because they are chemical-free and the oxygenated water can have cleaning power comparable to bleach.

Soap- or detergent-based systems and oxygen-based systems clean different types of surfaces with different levels of efficacy. For example, soap- or detergent-based systems are good at cleaning up oily or sticky messes whereas oxygen-based systems are good at cleaning up highly traveled areas where bacterial reduction may be of greater interest.

To date, it has been problematic to combine the features of these two cleaning paradigms without undercutting some of the features of the other. Further, while traditional soap-based fluid systems and ozone-generation systems each have their own benefits, they also highly dependent on correct user operation. Given the disparate paradigms for operation and that it is inevitable that not all operators will operate the machines as intended, the current state of the art is fraught with problems relating to the attempted combination (intentional or non-intentional) of these technologies.

For example, many systems operate by creating ozone or oxygenated water using electrochemical processes on the water itself as the water is transported from the clean water tank to the outlet near the brush deck. It is very easy for an unknowing operator to mistakenly mix soap or detergent into the clean water tank with the water, resulting in damage to the equipment which creates the ozone-containing or highly oxygenated water. Even a few mistakes of this kind can require servicing of the floor cleaning machine, costing hundreds or thousands of dollars, and/or lead to non-effective operation of the machine because the primary cleaning mechanism is degraded by improper use.

Still further, some oxygen-based systems may introduce ozone into the water stream without processing the water itself (e.g., using an ozone generator which places the ozone, created from atmospheric gas, into the water stream). It may be acceptable to utilize soapy water in those systems, because doing so would not affect the mode of ozone generation which is injected into the water stream from the clean water tank rather than created from it. However, the use of soapy water largely defeats the purpose of such oxygen-based cleaning systems in the first place because the benefits of chemical-free, soap-less operation from using the oxygen-based system is subverted. While it may be possible to switch the clean water tank between soapy and non-soapy water, doing so takes time and requires the clean water tank to be drained and its contents to be replaced.

Accordingly, there is a continuing need for a floor cleaning machine that can operate using both oxygen-based and soap-based cleaning fluids without comprising operation or efficiency of the overall machine.

SUMMARY OF THE INVENTION

Disclosed herein are improvements to traditional soap-based systems and oxygen-based systems for floor cleaning machines in which a single floor cleaning machine contains both a soap-based fluid system and an oxygen-based fluid system which connect a clean water tank to an outlet or outlets near the brush deck. This dual fluid system floor cleaning machine incorporates both soap-based and oxygen-based fluid systems for supplying cleaning fluid in a way that are compatible with one another and their combination does not undermine eithers separate utility. Ideally, in the soap-based fluid system, the soap or detergent is placed in a soap or detergent well which feeds the soap or detergent into the water as it is transported from the clean water tank to an outlet near the brush deck. Still further, in the oxygen-based fluid system, an external ozone generator may be utilized that injects ozone into the fluid stream. In this way, if an operator mistakenly places soap or detergent into the water in the clean water tank, this soap-containing fluid may still pass through the oxygen-based fluid lines and be injected with ozone, without damaging the ozone generator. It is contemplated that these systems may be separately constructed in a single device and include no shared structure/common elements or may be constructed in such a way that they include at least some shared structure or common elements.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
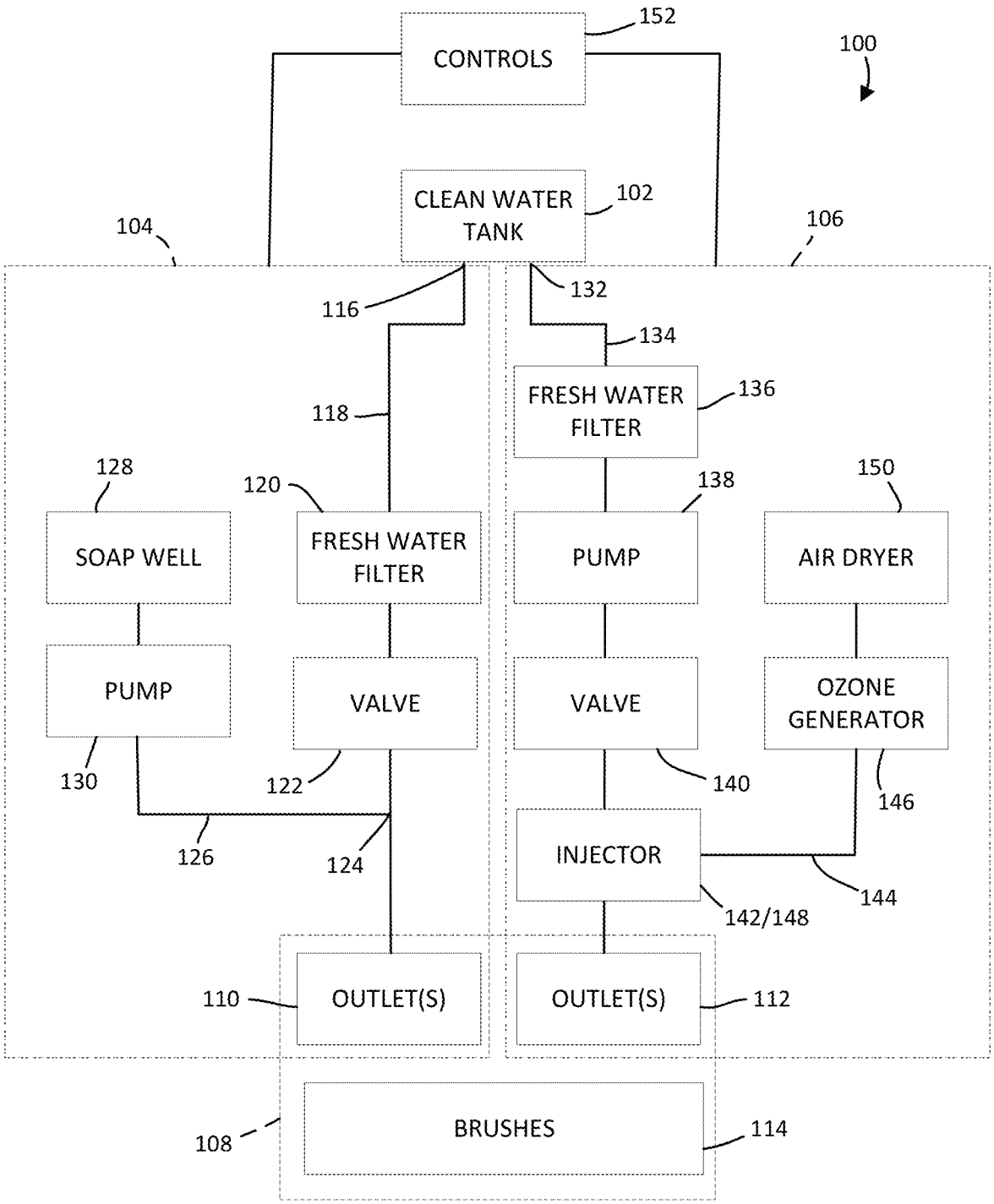
FIG. 1 is a block diagram of a floor maintenance machine incorporating the dual fluid supply systems.
Figure 2:
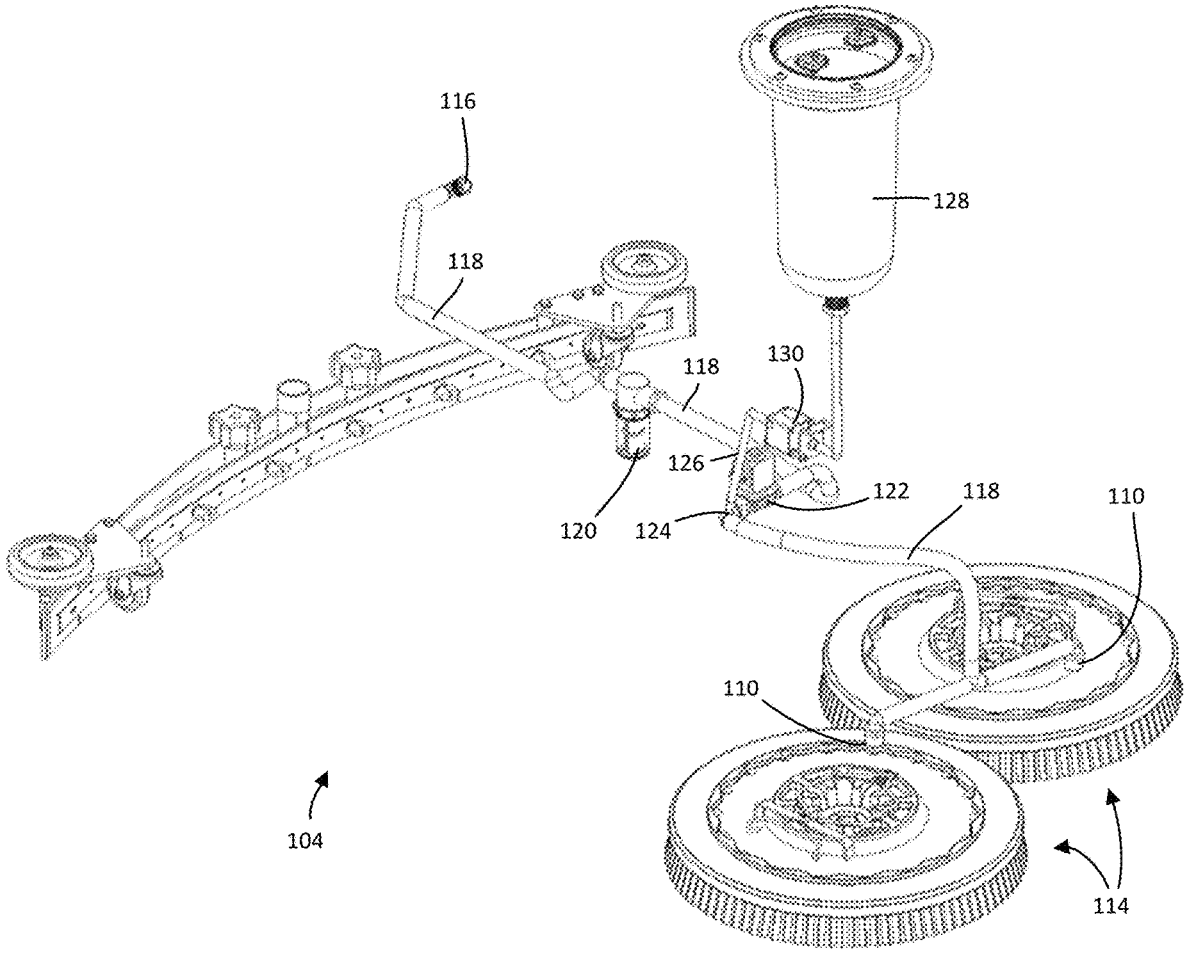
FIG. 2 is a perspective view of the first fluid supply system for introducing soap or detergent into the cleaning water in which the first fluid supply system is shown in isolation (i.e., not showing the second fluid supply system) with the rest of the floor maintenance machine hidden except for the rear wiper and front disc brushes.
Figure 3:
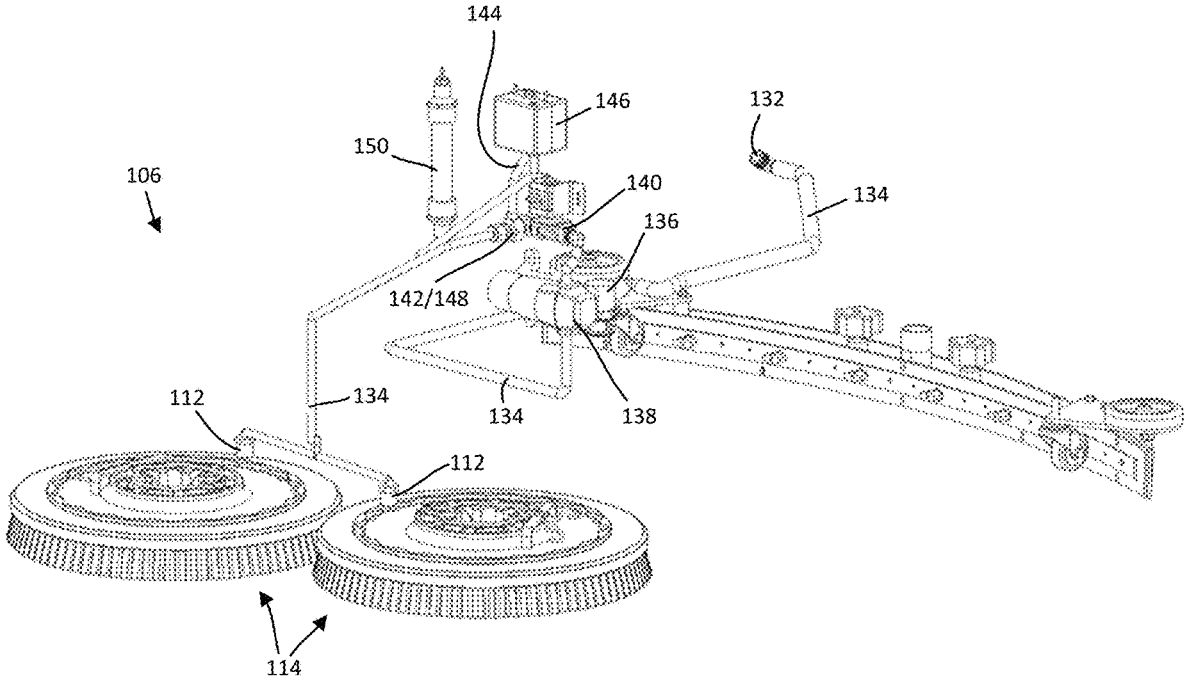
FIG. 3 is a perspective view of the second fluid supply system for introducing ozone into the cleaning water in isolation (i.e., not showing the first fluid supply system) and with the rest of the floor maintenance machine hidden except for the rear wiper and front disc brushes.

Referring first to FIG. 1, a block diagram of a floor maintenance machine 100 is illustrated in which the floor maintenance machine is adapted for supplying a cleaning fluid to a floor which is then scrubbed by brushes or pads. A black and white line drawing of the full machine is not provided herein, however the pertinent internal components are illustrated in FIGS. 2 and 3. For purposes of aiding the understanding of the reader about the construction and the nature of a floor cleaning machine, the reader can refer to U.S. Pat. No. 8,505,156 filed on Sep. 21, 2007 and U.S. Patent Application Publication No. 2016/0331112 filed on May 14, 2015, which are incorporated herein by reference in their entirety for all purposes. The description of the floor maintenance machine 100 that follows applies to all types of floor maintenance machines wherein the machine is a "rider" with a seat or a walk-behind unit and regardless of brush or pad type (e.g., disc brushes, cylinder brushes, and so forth).

As can be generally seen in FIG. 1, the floor maintenance machine 100 includes a clean water tank 102 which is connected to a first fluid supply system 104 and a second fluid supply system 106. As illustrated, the first fluid supply system 104 and the second fluid supply system 106 selectively and independently provide cleaning fluid from the clean water tank 102 to the brush deck 108 at a first set of outlets 110 and a second set of outlets 112, respectively, with the brush deck 108 housing the brushes 114 therein. This fluid, along with any cleaning agent is supplied to the floor to be cleaned in the vicinity of the brushes 114, and the brushes 114 work the fluid on the surface of the floor to clean it. Subsequently, the fluid will be collected using a vacuum or cleanup system at a rear wiper, which is discussed elsewhere in the state of the art but which detail are not significant to the instant disclosure.

It should be appreciated at this point that while the embodiment illustrated herein includes two fluid supply systems sharing no common components and which each separately connect a clean water tank to respective outlets at the brush deck, that it is also contemplated that the two fluid supplied systems could be at least partially integrated with one another. For example, they may share fluid lines, valves, outlets, or common pump elements. Again, while the illustrated embodiment is exemplary it is not limiting to that specific type of structure.

Returning now to the description of the illustrated embodiment, the structure of the first fluid supply system 104 and the second fluid supply system 106 will now be separately described in greater detail with further reference being made to FIGS. 2 and 3.

Referring now to FIGS. 1 and 2, the first fluid supply system 104 is designed to introduce soap or detergent into the clean water from the clean water tank 102 prior to the water exiting the outlets 110. A first connection 116 connects a first fluid line 118 to the clean water tank 102. The first fluid line 118 runs through a fresh water filter 120 and a valve 122 before reaching a juncture 124 at which the first fluid line 118 is connected to a soap-providing line 126. A soap or detergent well 128 is connected to the soap providing line 126 as is a pump 130 which can selectively pump soap from the soap well 128 into the first fluid line 118 from the soap-providing line 126 at the juncture 124. After the juncture 124, the first fluid line 118 extends to the outlet 110.

When the first fluid supply system 104 is to be used, the valve 122 is opened and the pump 130 is run. This is a gravity fed system and, under the force of gravity, clean water from the clean water tank 102 flows through the first fluid line 118 to the outlets 110. As the water flows through the line, it passes first through the fresh water filter 120, through the open valve 122, and then has some amount of soap or detergent added to it at the juncture 124. The concentration of the soap or detergent in the water is dependent on both the flow rate of the fluid through the first fluid line 118 as well as on the rate at which the pump 130 pumps the soap or detergent from the soap or detergent well 128. By careful control of both flow rates, the desired dilution rate may be achieved. After the soap or detergent is injected into the stream of in the first fluid line, the soap- or detergent-containing cleaning water can now exit outlet 110 into the brush deck 108 for use in cleaning the floor.

Referring now to FIGS. 1 and 3, the second fluid supply system 106 is designed to introduce ozone into the clean water from the clean water tank 102 prior to the water exiting the outlets 112. A second connection 132 connects a second fluid line 134 to the clean water tank 102. The second fluid line 134 runs through a fresh water filter 136 (which is separate and different from the fresh water filter 120 in the first fluid supply system 104), a water pump 138, and a valve 140 (again, which is different than the valve 122) before reaching a juncture 142 at which the first fluid line 118 is connected to an ozone-providing line 144. An ozone generator 146 is connected to the ozone-providing line 144 to selectively provide ozone gas to any liquid in the second fluid line 134 at an injector 148 at the juncture 142 of the second fluid line 134 and the ozone-providing line 144. An air dryer 150 is also connected to the ozone generator 146 which can dry the air which is processed by the ozone generator 146 to help facilitate the production of ozone. After the injector 148, the second fluid line 134 extends to the outlets 112 into the brush deck 108 so that any ozone-containing fluid can be used to clean the floor.

When it is desired to use the second fluid supply system 106, the water pump 138 is turned on, the valve 140 is opened, and the ozone generator 146 is turned on. In this way water is drawn from the clean water tank 102 is pumped through the filter 136, through the water pump 138, through the valve 140, through the injector 148 which injects ozone into the water which is generated by the ozone generator 146, and flows out the outlets 112 into vicinity of the brush deck 108 for cleaning. It will be appreciated that injection of ozone into the fluid is somewhat more difficult to control than the injection of soap and so the pump 138 and valve 140 along with the rate of ozone generation by the ozone generator 146 can be carefully balanced to apply the desired dosing.

One benefit of the illustrated structure of the second fluid supply system 106 is that the on-board ozone generation is introduced after the pumps and valves so that the ozone cannot attack their rubber seals.

Figure 4:
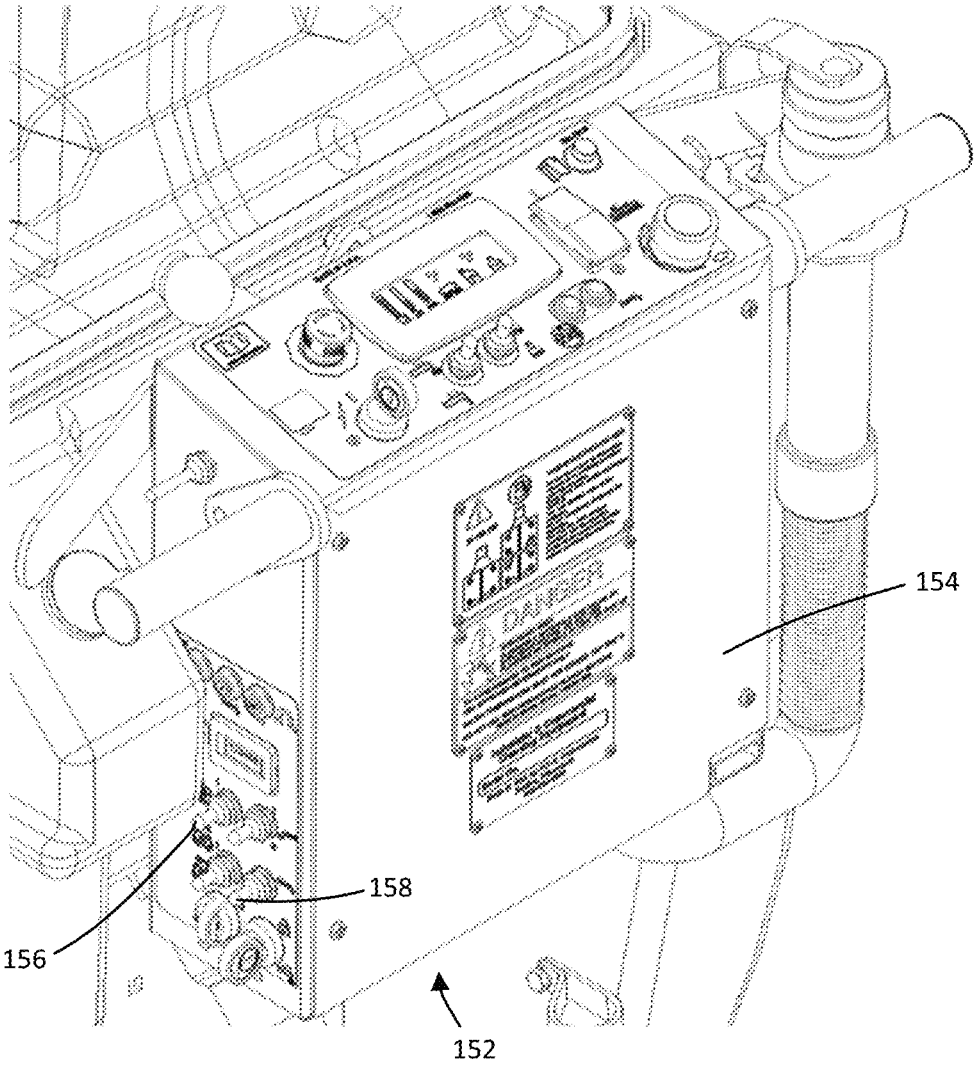
FIG. 4 is a detailed view of the control panel for operation of the floor maintenance machine and the dual fluid supply systems.

Turning now to FIG. 4, a control panel or controls 152 are illustrated which separately control the operation of the first fluid supply system 104 and the second fluid supply system 106 (which connectivity is also denoted by the lines connecting the controls 152 to the first fluid supply system 104 and the second fluid supply system 106 in FIG. 1). In the form illustrated, these controls 152 are positioned on a control box 154 at the rear end of a walk-behind floor maintenance machine; however, as noted above, the type of machine is not so limited and nor, for that matter, are the specific arrangement of the controls 152. As illustrated, there are multiple individual control elements on the side of the control box 154 including a three-position toggle switch 156 for control of the first fluid supply system 104 which is movable between an off position, an on position with a 250:1 dilution ratio, and an on position with a 125:1 dilution ratio for control of the soap- or detergent-containing fluid production. There is also an on/off toggle switch 158 for the second fluid supply system 106 which controls the ozone-containing fluid production in the second fluid supply system 106. On the top of the control box 154, there is an LCD display which provides the operational state of the first fluid supply system 104 and an indicator light which indicates the status of the second fluid supply system 106. Again, it should be appreciated that this particular arrangement of controls is for exemplary purposes only and the type and manner of control [i.e., number of different operational setting, types of controls used (toggle v. knob v. touchscreen, etc.)] may be different.

For example, it is contemplated that rather than having a simple on/off toggle switch 158 for operation of the ozone system, a multi-position toggle or other control might be present that permits operation at two or more concentration levels as well as having an off position (e.g., having an off position, normal concentration position, and high concentration position). In this vein, it is also contemplated that the ozone system may have multiple small gaseous ozone generators connected in series to permit partial capacity operation for a given machine. For example, for a walk-behind scrubber, there may be two 12-vdc gaseous ozone generators wired in series for a total of 24-vdc capacity. While both generators may be operated simultaneously to produce 24-vdc (100% capacity), one may be turned off while the other is on to operate at 12-vdc (50% capacity of ozone generation). As another example, a rider machine may have three small generators (e.g., three 12-vdc generators wired in series to provide 36-vdc maximum potential) to selectively operate at 0%, 33%, 66%, or 100% capacity or, depending on the wiring, just at some of those percentages (e.g., off, 66%, and 100%). These are just some examples and there could also be other numbers of generators and/or different capacity generates wired together to produce a selective ozone generation may operate at partial to full capacity. In this way, the ozone generation and concentration in the water might be adjusted depending on the circumstances. Advantageously, this may reduce the generation of ozone as needed or desired, for example, to reduce power consumption of the machine or when the machine is operated in a small room with poor ventilation where large amounts of ozone generation may not be desired.

In any event, these controls 152 permit for the first fluid supply system 104 and the second fluid supply system 106 to be separately operated. Thus, this system may operate a water plus soap mode (first fluid supply system only), a water plus ozone mode (second fluid supply system only), a water plus soap plus ozone mode (first and second fluid supply systems together), and even modes in which soapy water is placed in the clean water tank plus one or both of further soap or ozone operational modes to add an additional cleaning agent.

This extreme flexibility in states means that the machine 100 can be toggled, for example, from oxygen cleaning to soap/detergent cleaning and back again, with by simply changing the controls. This would be helpful, for example, if the floor is to be primarily cleaned using oxidative cleaning, but upon reaching a greasy spot or soda spill, soap cleaning is preferred. This avoids downtime and/or the possibility of needing to drain and refill the tank multiple times to clean a single spot as would be the case in a system which primarily operates using ozone cleaning.

Still yet, another advantage of the disclosed floor cleaning machine is that if one of the two modes of operation fail, then the other mode of cleaning may be utilized until the broken mode can be repaired.

Still further, because the ozone-creating supply system does not process the water itself to produce ozone, if an operator inadvertently puts soapy water into the clean water tank, the soapy water will not damage the ozone generator. Thus, in many ways, the disclosed machine does not require careful use by the operator. While careful use will certainly improve efficiency of the floor cleaning machine, improper use is unlikely to damage the machine.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A floor maintenance machine comprising:

a clean water tank;

a brush deck having one or more outlets thereat;

a first fluid supply system placing the clean water tank in fluid communication with at least one of the one or more outlets at the brush deck, the first fluid supply system including a first fluid supply line adapted to receive at least one of a soap or detergent therein supplied from a soap or detergent well;

a second fluid supply system placing the clean water tank in fluid communication with at least one of the one or more outlets at the brush deck, the second fluid supply system including an ozone generator and a second fluid supply line adapted to receive injected ozone therein in which the ozone is generated from the ozone generator.

2. The floor maintenance machine of claim 1, wherein the first fluid supply system and the second fluid supply system are independently operable of one another.

3. The floor maintenance machine of claim 1, wherein the first fluid supply system is gravity-driven.

4. The floor maintenance machine of claim 1, wherein the second fluid supply system includes a pump for pumping water from the clean water tank to the one or more outlets.

5. The floor maintenance machine of claim 1, wherein the ozone generator generates ozone from an atmospheric gas that passes through an air dryer before entering the ozone generator.

6. The floor maintenance machine of claim 1, wherein a fluid from the clean water tank can flow from the clean water tank to the one or more outlets without flowing through the ozone generator.

7. The floor maintenance machine of claim 1, further comprising controls operable to selective operate the first fluid supply system and the second fluid supply system separately or in combination with one another.

8. The floor maintenance machine of claim 1, wherein the first fluid supply system and the second fluid supply system share no common components.

9. The floor maintenance machine of claim 1, wherein the first fluid supply system and the second fluid supply system include shared components with one another.

10. The floor maintenance machine of claim 1, wherein the first fluid supply system connects to the clean water tank at a first connection and the second fluid supply system connects to the clean water tank at a second connection different than the first connection.

11. The floor maintenance machine of claim 1, wherein the first fluid supply system and the second fluid supply system share at least one outlet.

12. The floor maintenance machine of claim 1, wherein the first fluid supply system and the second fluid supply system each have different outlets from one another.

13. The floor maintenance machine of claim 1, wherein the ozone generator includes multiple gaseous ozone generators arranged in series in which all of the multiple gaseous ozone generators are operable simultaneously to operate at 100% capacity for ozone gas generation or a subset of less than all of the multiple gaseous ozone generators are operable at less than 100% capacity for ozone gas generation.

* * * * *